United States Patent [19]

Sakamoto et al.

[11] 4,040,837

[45] Aug. 9, 1977

[54] PHOTOGRAPHIC BLEACH-FIXER

[75] Inventors: Kenro Sakamoto; Isamu Fushiki; Sigeharu Koboshi, all of Hino, Japan

[73] Assignee: Konishiroku Photo Industry Co., Ltd., Nihonbashi-Muro, Japan

[21] Appl. No.: 636,948

[22] Filed: Dec. 2, 1975

[30] Foreign Application Priority Data

Dec. 5, 1974 Japan ..... 49-140322

[51] Int. Cl.[2] ..... G03C 5/32

[52] U.S. Cl. ..... 96/60 BF

[58] Field of Search ..... 96/60 BF, 60 R, 22, 96/49

[56] References Cited

U.S. PATENT DOCUMENTS

| | | | |
|---|---|---|---|
| 3,770,437 | 11/1973 | Brugger | 96/60 R |
| 3,809,563 | 5/1974 | Nimura et al. | 96/60 BF |
| 3,820,997 | 6/1974 | Shirasu et al. | 96/60 R |
| 3,879,202 | 4/1975 | Yamaguchi | 96/60 BF |
| 3,948,659 | 4/1976 | Yamaguchi et al. | 96/60 BF |

*Primary Examiner*—Mary F. Kelley

[57] ABSTRACT

This invention is directed to a bleach-fix which is stable, excellent in bleach-fix efficiency, applicable to the processing of high-speed, light sensitive silver halide color photographic materials and free from problems of environmental pollution.

5 Claims, No Drawings

PHOTOGRAPHIC BLEACH-FIXER

This invention relates to a bleach-fixer for use in the bleach-fixing step of a light-sensitive silver halide photographic material. More particularly, the invention pertains to a bleach-fixer which is stable and excellent in bleach-fixing efficiency and which can effectively be used also for the processing of a high speed, light-sensitive silver halide color photographic material.

For the obtainment of a color image by the development of an exposed, light-sensitive silver halide color photographic material, there is generally known such process that after the color development step, the developed silver image is bleached with an oxidizing agent (bleaching agent) and then fixed by removing the silver image with a fixing agent. In contrast to the said process in which bleaching and fixing are effected in separate steps, there has been proposed a processing called "bleach-fixing" in which bleaching and fixing are simultaneously completed in one step, simplifying the process steps for the purpose of quick processing and labor-saving.

Generally, the bleach-fixer used in the bleach-fixing step is an aqueous solution containing a bleaching agent and a fixing agent as main ingredients. As the bleaching agent, there is used, for example, potassium ferricyanide, iron chloride, or an organometallic complex salt such as iron salt of ethylenediaminetetraacetic acid, while as the fixing agent, there is used a thiosulfate such as sodium or ammonium thiosulfate, a thiocyanate such as potassium or sodium thiocyanate, or thiourea, which is a fixing agent used ordinarily for the fixing of a light-sensitive silver halide photographic materials. Such bleaching agents as potassium ferricyanide and iron chloride are high in oxidizing power and thus are favorable bleaching agents.

However, a bleach-fixer using potassium ferricyanide as the bleaching agent yields cyan by photolysis to cause environmental pollution, so that the bleach-fixer wasted after processing of silver halide photographic material should be subjected to such treatment as to be made completely safe from environmental pollution. On the other hand, a bleach-fixer using iron chloride as the bleaching agent is extremely low in pH and markedly great in oxidizing power, and hence brings about not only such disadvantage that the members of a processing machine filled therewith is liable to be corroded but also such disadvantage that iron hydroxide deposits in the emulsion layer of photographic material at the water-washing step after bleaching to form so-called stains on the surface of the photographic material. If such bleaching agent as above is used, therefore, the photographic material after bleaching should necessarily be treated with an organic chelating agent, with the result that it becomes impossible to achieve the object of quick processing and labor-saving, and there is brought about a problem from the standpoint of prevention of environmental pollution.

Since an organometallic complex salt such as iron salt of ethylenediaminetetraacetic acid is less in toxicity than potassium ferricyanide and iron chloride and thus is more advantageous from the standpoint of prevention of environmental pollution, the use of said complex salt as the bleaching agent has recently been recommended. However, the organometallic complex salt is relatively low in oxidizing power and consequently insufficient in bleaching power. Accordingly, in the case where a low speed, light-sensitive silver halide color photographic material containing, for example, a silver chlorobromide emulsion is desired to be bleach-fixed, a bleach-fixer using the said organometallic complex salt as the bleaching agent will make it tentatively possible to accomplish the desired object, but in the case where a high speed, light-sensitive silver halide color photographic material which contains a silver chloroiodobromide or iodobromide emulsion and which has been color-sensitized, particularly a light-sensitive silver halide color reversal photographic material using a high silver content emulsion, is desired to be bleach-fixed, bleaching is insufficient and removal of silver images becomes inferior, with the result that the bleach-fixing efficiency becomes too low to accomplish the desired object.

Heretofore, there have been conducted various studies in order to obtain a bleach-fixer using an organometallic complex salt as the bleaching agent which can effectively be applied to the processing of a high speed, light-sensitive silver halide color photographic material. For example, there has been made such attempt that the concentration of the bleaching agent in a bleach-fixer is made higher in order to enhance the bleaching efficiency. Indeed, the enhancement of bleaching power can be observed more or less by increasing the concentration of an organo-metallic complex salt as the bleaching agent. However, even when the concentration of said bleaching agent is increased to a solubility limit, the bleach-fixer is still insufficient for the processing of a high speed, light-sensitive silver halide color photographic material, particularly such high silver content photographic material as a reversal type silver halide color photographic material. Further, if the concentration of the bleaching agent is made excessively high, there is observed such tendency that the bleach-fixer is rather degraded in processability.

Since no sufficient bleach-fixing is possible even if the concentration of only the bleaching agent of bleach-fixer is increased as mentioned above, there has further been made such attempt that various bleaching accelerator such as organic sulfur compounds, quaternary ammonium compounds, etc. are added to the above-mentioned system to enhance the bleach-fixing power thereof. While some bleaching accelerators can successfully enhance the bleach-fixing efficiency, however, most of them have such other disadvantages that they are low in stability in bleach-fixers and are not storable therein over a long period of time. Particularly in a fatigued bleach-fixer used in a process of such type that a photographic material to be processed is introduced from a color developer directly into a bleach-fixer, the said bleaching accelerators are extremely unstable and tend to form precipitates. Further, in a processing apparatus of such structure that a bleach-fixer is liable to migrate into a color developer, a small amount of the bleaching accelerator migrates into the color developer, with the result that such undesirable influence as the formation of color fog is frequently given to the photographic properties of light-sensitive material. While it is tentatively possible to enhance the bleach-fixing efficiency by use of bleaching accelerator as mentioned above, the bleaching accelerators have such disadvantages as mentioned previously, so that bleach-fixers incorporated with bleaching accelerator have not practically been used for the processing of high speed, light-sensitive silver halide color photographic materials.

On the other hand, there has also been proposed a bleach-fixer of the type different from that mentioned above. That is, German Patent 1051117, for example, discloses a bleach-fixer of such composition that a bleaching agent consisting of an iron salt of ethylenediaminetetraacetic acid is used in combination with a large amount of a halogen salt such as potassium bromide or potassium iodide. Since no thiosulfate is contained in this bleach-fixer, it is considered that the halogen salt used acts as a kind of fixing agent. This bleach-fixer is relatively favorable in bleaching power, but has such disadvantage that it deposits silver halide in the emulsion layer of photographic material at the water-washing step after bleach-fixing treatment and, when a negative or positive film is processed therewith, the finished film becomes opaque. This phenomenon is marked when even a slight amount of silver ion has been dissolved in the bleach-fixer. Accordingly, when the fatigued bleach-fixer is used, the processed film becomes completely opaque.

It is also disclosed in the above-mentioned German patent that a slight amount of thiosulfate or thiourea is added to such bleach-fixer incorporated with a large amount of halogen salt. However, even when a slight amount of thiosulfate or the like is added, it is impossible to prevent the aforesaid deposition of silver halide in the emulsion layer of photographic material at the water-washing step, and thus the processed film unavoidably becomes opaque. For these reasons, the bleach fixers disclosed in said German patent have not yet been practically used for the processing of high speed, light-sensitive silver halide color photographic materials.

As stated above, bleach-fixers of various types have been proposed hitherto. Nevertheless, there has been found no practical bleach-fixer which is effectively applicable to high speed, light-sensitive silver halide color photographic materials, and so the advent of a practical bleach-fixer free from such disadvantages as mentioned above is strongly demanded.

An object of the present invention is to provide a bleach-fixer, which is free from problems of environmental pollution and hence is advantageous from the standpoint of prevention of environmental pollution, quite excellent in bleach-fixing efficiency, stable and, nevertheless, effectively applicable also to the processing of high speed, light-sensitive silver halide color photographic materials.

The present inventor has found that the above-mentioned object can be accomplished by a bleach-fixer containing, per liter, 0.1 to 1.5 moles of a bleaching agent composed of an organometallic complex salt, 0.2 to 3.0 moles of a silver halide-fixing agent, and 0.5 to 7.0 moles of a halide of the general formula, $$A - X$$

wherein A is hydrogen, lithium, sodium or potassium or ammonium, and X is bromine or iodine.

That is, the bleach-fixer of the present invention is characterized by containing as main ingredients a bleaching agent composed of an organometallic complex salt, a silver halide-fixing agent and a halide of the above-mentioned general formula in such proportions as defined above. Unless the proportions of the main ingredients are out of said ranges, the object of the present invention cannot effectively be accomplished.

The organometallic complex salt as the bleaching agent used in the present invention is a compound acting as an oxidizing agent for silver, and typical examples thereof are organometallic complexes prepared by coordinating iron (III), cobalt (III), copper (II) or the like metal ions with an organic acid such as ethylenediaminetetraacetic acid, nitrilotriacetic acid, diethylenetriaminepentaacetic acid, 1,2-cyclohexanediaminetetraacetic acid, glycol ether diaminetetraacetic acid, oxybis-(ethyleneoxyethylenenitrilo) tetraacetic acid, oxalic acid or citric acid.

The silver halide-fixing agent used in the present invention is a compound capable of forming a water-soluble complex salt by reaction with silver halide which is used in ordinary fixing treatment, and typical examples thereof are thiosulfates such as potassium, sodium and ammonium thiosulfates, thiocyanates such as potassium, sodium and ammonium thiocyanates, thiourea and thioethers. Although alkali metal or ammonium halides sometimes show fixing actions, these halides are not involved in the silver halide-fixing agent used in the present invention.

The halide of the aforesaid general formula which is used in the present invention includes, for example, hydrobromic acid, lithium bromide, sodium bromide, potassium bromide, ammonium bromide, potassium iodide and ammonium iodide. Among these, bromides are particularly effective. A halide containing a chlorine or bromine atom cannot display the effect aimed at by the present invention.

Each of the above-mentioned main ingredients may be used either singly or in combination of two or more members. In case the ingredient used is in combination of two or more members, the mixing proportions thereof are optional.

One of the characteristics of the bleach-fixer of the present invention is that the halide of the aforesaid general formula is contained in a larger amount. It has heretofore been expected that when incorporated with such halide as mentioned above, a bleach-fixer or bleacher is greatly inhibited in fixing property. That is, the fixing-inhibiting property of such halide is disclosed in detail in, for example, "Photographic Science & Engineering," Vol. 17, No. 2, page 174 (1973). Accordingly, even when a halogen ion is desired to be made present in order to carry out halogenation at the silver-bleaching step, it has been an ordinary practice to add the halogen ion in an amount as small as possible, i.e. in such a small amount as required for the halogenation.

However, when a large amount of said halide, which has generally been considered to have a fixing-inhibiting property, is used in combination with the aforesaid bleaching agent and fixing agent in such quantitative proportions as regulated in the present invention, not only the halide does not show any fixing-inhibiting property at all but also there is obtained a bleach-fixer having excellent characteristics capable of sufficiently accomplishing such object of the present invention as mentioned previously. This is an entirely unexpected and surprising matter. That is, when such halide as mentioned previously is added, there are obtained such advantages that not only bleach-fixing efficiency is greatly enhanced and a high speed light-sensitive silver halide photographic material can sufficiently be bleach-fixed in a short period of time, but also high bleach-fixing efficiency can be attained even when the said bleaching agent and fixing agent are used at concentrations far lower than in the case of a conventional bleach-fixer. These advantages directly reflect in the protection of resources and in the prevention of environmental pollution, and thus make it possible to supply with ease a bleach-fixer less in problem of environmental pollution and low in cost.

The bleach-fixer of the present invention is excellent in stability and low in cost, since it is not necessary to make the bleaching agent and the fixing agent excessively high in concentration or to use an expensive and unstable bleaching accelerator or the like in order to enhance the bleach-fixing efficiency thereof. In addition, the bleach-fixer of the present invention has such advantage that even in the case where the bleach-fixer is desired to be made higher in concentration prior to its use, all the main ingredients are so high in solubility that the bleach-fixer can easily be made higher in concentration and can be prepared with ease. Particularly, the bleach-fixer of the present invention is not required to be incorporated with any bleaching accelerator, so that it is extremely high in stability and is not deteriorated in processability or does not form precipitates due to carried-in color developer and/or other processing solutions or dilution of the bleach-fixer, unlike in the case of the conventional bleach-fixer which has been incorporated with such bleaching accelerator as an organic sulfur compound, quaternary ammonium compound or selenium compound. Moreover, the bleach-fixer of the invention is high in stability, so that the regeneration and the repeated use of the solution are also easy.

Since the bleach-fixer of the present invention is markedly excellent in bleach-fixing power as mentioned previously, it is effectively applicable to the processing of not only low speed but also high speed light-sensitive silver halide color photographic materials, and can be applied in common to the processing of every type of light-sensitive silver halide color photographic materials which are required to be bleached and fixed, e.g. color printing light-sensitive materials such as photographic printing papers, and photographing light-sensitive materials such as negative color films, reversal color films, etc.

Heretofore, light-sensitive silver halide color photographic materials different in kind have not been able to be processed by use of one bleach-fixer, and bleach-fixers or bleachers of different prescriptions have necessarily been required to be used in separate processing lines. By use of the bleach-fixer of the present invention, however, it becomes possible to use one processing solution in processing lines of every kind of light-sensitive silver halide color photographic materials. This not only makes it possible to save the labor required for preparing processing solutions but also makes it possible to use excess solution or waste solution in other processing lines, with the result that the amount of discharged solution can be minimized. Thus, the use of the bleach-fixer of the present invention is extremely advantageous from the standpoint of cost, protection of resources and prevention of environmental pollution.

In the case of the bleach-fixer of the present invention, silver ions dissolved in the bleach-fixer can be easily recovered according to metal substitution method using iron wool or to electrolytic method, like in the case of the conventional bleach-fixer. At the same time, the bleach-fixer of the present invention is extremely high in stability. Accordingly, the bleach-fixer, after recovery of silver ions, may if necessary be regenerated by addition of a regenerant or replenisher, and then can be put into repeated use.

The bleach-fixer of the present invention may, if necessary, be incorporated with various additives. For example, the bleach-fixer may be incorporated with one or two or more of pH buffer agents such as boric acid, borax, sodium hydroxide, potassium hydroxide, sodium carbonate, potassium carbonate, sodium bicarbonate, potassium bicarbonate, acetic acid, sodium acetate and ammonium hydroxide, or with various fluorescent brightening agents, defoaming agents or surfactants. Further, the bleach-fixer may properly be incorporated with a preservative such as a bisulfite addition product of hydroxylamine, hydrazine or aldehyde compound, an organic chelating agent such as aminopolycarboxylic acid, a stabilizer such as nitroalcohol, or an organic solvent such as methanol, dimethyl sulfonamide or dimethyl sulfoxide. The bleach-fixer of the present invention is extremely great in bleach-fixing power and hence is not necessarily be incorporated with any bleach-fixing accelerator. If desired, however, the bleach-fixer may optionally be incorporated with any of such bleach-fixing accelerators as disclosed in, for example, Japanese Patent Application Laying-Open-to-Public Nos. 279/1971, 280/1971, 27906/1971, 7535/1972, 84440/1974 and 42349/1974, Japanese Patent Publication Nos. 8506/1970, 8836/1970 and 556/1971, German Offenlegungsschrift Nos. 2063576, 2139401, 2162854 and 2152855, Swiss Patent 336257, and British Patent 1138842.

The bleach-fixer of the present invention is effectively applicable to every processing step in which bleaching and fixing treatments are required. From such viewpoint as the simplification of processing steps, however, it is desirable that the bleach-fixer is applied to a processing step in which a photographic material is bleach-fixed immediately after color development. If necessary, however, a photographic material after color development may be bleach-fixed with the bleach-fixer of the present invention after it has been subjected to at least one of water-washing, stop, stop-fixing and hardening treatments. For specific purpose, the photographic material after bleach-fixing with the bleach-fixer of the present invention may separately be subjected to fixing treatment.

The bleach-fixer of the present invention is preferably used at a pH of 2 to 9. In this case, the silver halide-fixing agent may properly be selected according to the pH value desired to be adopted. For example, in case the decomposability thereof is taken into consideration, a thiosulfate is desirably used when the pH adopted is 4 or more, and a thiocyanate is desirably used when the pH adopted is less than 4.

The present invention is illustrated below with reference to examples, but the scope of the invention is not limited to the examples.

EXAMPLE 1

Sakura Color II (a high speed color negative film produced by Konishiroku Photo Industry Co., Ltd.) was exposed to a definite amount of light from a tungsten lamp light source adjusted to a color temperature of 4900° K by use of a filter, and then subjected to such processings (a) and (b) as described below.

a. Control processing

The film was processed by use of Sakura Color Process CNK-4 produced by Konishiroku Photo Industry Co., Ltd., subjected successively to color development for 3 minutes and 15 seconds, bleaching for 6 minutes and 30 seconds, water-washing for 2 minutes, fixing for 8 minutes, water-washing for 4 minutes and stabilization treatment for 1 minute, and then dried.

b. Processing using each of the below-mentioned bleach-fixers A to J

The film was subjected successively to color development for 3 minutes and 15 seconds, bleach-fixing for 1 to 30 minutes, water-washing for 2 minutes and stabilization treatment for 1 minute, and then dried.

All the above-mentioned treatments were carried out at 37.8° ± 0.2° C. Among these treatments, those other than the bleach-fixing were effected by use of Sakura Color II Processing Agent, Type IV (produced by Konishiroku Photo Industry Co., Ltd.). The bleach-fixers A to D mentioned below are control bleach-fixers out of the scope of the present invention, while the bleach-fixers E to J are bleach-fixers within the scope of the present invention.

The composition of each bleach-fixer used was as shown below.

Bleach-fixer A:
Diammonium salt of ethylenediaminetetraacetic acid: 7.5 g.
Iron (III) salt of ethylenediaminetetraacetic acid: 67.5 g.
Sodium sulfite: 15.0 g.
60% Aqueous ammonium thiosulfate solution: 150 ml.
Water to make: 1 liter
Adjusted to pH 7.0 with ammonium hydroxide.
Bleach-fixer B:
Iron (III) salt of ethylenediaminetetraacetic acid: 67.5 g.
Ammonium bromide: 500.0 g.
Water to make: 1 liter
Adjusted to pH 6.2 with ammonium hydroxide.
Bleach-fixer C:
Disodium salt of ethylenediaminetetraacetic acid: 7.5 g.
Iron (III) salt of ethylenediaminetetraacetic acid: 67.5 g.
Sodium sulfate: 15.0 g.
60% Aqueous ammonium thiosulfate solution: 150 ml.
Potassium bromide: 35.0 g.
Water to make: 1 liter
Adjusted to pH 6.2 with sodium carbonate.
Bleach-fixer D:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 250 ml.
Water to make: 1 liter
Adjusted to pH 6.2 with ammonium hydroxide.
Bleach-fixer E:
Diammonium salt of ethylenediaminetetraacetic acid: 10.0 g.
Iron (III) salt of ethylenediaminetetraacetic acid: 67.5 g.
Sodium sulfite: 10.0 g.
60% Aqueous ammonium thiosulfate solution: 100 ml.
Ammonium bromide: 200.0 g.
Water to make: 1 liter
Adjusted to pH 6.2 with ammonium hydroxide.
Bleach-fixer F:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 150 ml.
Ammonium bromide: 150.0 g.
Water to make: 1 liter
Adjusted to pH 6.2 with ammonium hydroxide.
Bleach-fixer G:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 150 ml.
Sodium bromide: 150.0 g.
Water to make: 1 liter
Adjusted to pH 6.2 with ammonium hydroxide.
Bleach-fixer H:
Diammonium salt of ethylenediaminetetraacetic acid: 10.0 g.
Iron (III) salt of ethylenediaminetetraacetic acid: 150.0 g.
Ammonium thiocyanate: 100.0 g.
Ammonium bromide: 150.0 g.
Poly-N-vinyl-2-pyrrolidone (MW Ca. 40,000): 5.0 g.
Water to make: 1 liter
Adjusted to pH 6.2 with ammonium hydroxide.
Bleach-fixer I:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 150 ml.
Ammonium iodide: 500.0 g.
Water to make: 1 liter
Adjusted to pH 6.2 with ammonium hydroxide.
Bleach-fixer J:
Diammonium salt of ethylenediaminetetraacetic acid: 10.0 g.
Iron (III) salt of ethylenediaminetetraacetic acid: 65.0 g.
Sodium sulfite: 10.0 g.
60% Aqueous ammonium thiosulfate solution: 150.0 ml.
Ammonium bromide: 200.0 g.
Ammonium iodide: 200.0 g.
Water to make: 1 liter
Adjusted to pH 6.2 with ammonium hydroxide.

In the above processing, the bleach-fixers A to J were compared with each other in bleach-fixing efficiency by measuring the bleach-fixing completion time (clearing time) of the film, the amount of residual silver at the time when the film was bleach-fixed for a short period of time (2 minutes), and the neutral density of the processed film. The results obtained were as shown in Table 1. The bleach-fixing completion time is a time required until all of bleached silver and unbleached silver at the exposed and unexposed portions were removed out of the processed film, and the neutral density is the density of samples processed for a certain period of time measured under a white light. The density is contributed by dye, bleached silver and unbleached silver. Although residual silvers were measured as to be zero by a chemical analysis in some samples, clear bleach-fixed images were obtained by the bleach-fixing for a short period of time (2 minutes). In order to obtain clear bleach-fixed images, longer treatment times were required. The data given in Table 1 with regard to bleach-fixers F to J show this fact.

Table 1

| | Control* | Bleach-fixer out of the scope of the invention | | | | | Bleach-fixer within the scope of the invention | | | | |
|---|---|---|---|---|---|---|---|---|---|---|---|
| | | A | B | C | D | E | F | G | H | I | J |
| Amount of residual silver when bleach-fixing was effected for 2 minutes (mg/100 cm²) | 0 | 6.0 | 2.4 | 5.5 | 1.4 | 0.2 | 0 | 0 | 0 | 0 | 0 |
| Neutral density when bleach-fixing was effected for 2 minutes | 2.51 | 3.45 | 3.21 | 3.15 | 2.89 | 2.54 | 2.50 | 2.50 | 2.51 | 2.20 | 2.40 |
| Bleach-fixing completion time (clearing time) | 3 min. | More than 20 min. | More than 20 min. | More than 20 min. | More than 20 min. | 6 min. | 3 min. | 3.5 min. | 3 min. | 3 min. | 3 min. |

*Bleaching and fixing were effected in separate steps.

From Table 1, it is understood that the bleach-fixing does not complete within an ordinary processing time if there is used each of the bleach-fixer A containing iron (III) salt of ethylenediaminetetraacetic acid (bleaching agent) and ammonium thiosulfate (fixing agent) but no halide, the bleach-fixer B containing iron (III) salt of ethylenediaminetetraacetic acid (bleaching agent) and ammonium bromide (fixing agent) but no thiosulfate, the bleach-fixer C containing iron (III) salt of ethylenediaminetetraacetic acid (bleaching agent), ammonium thiosulfate (fixing agent) and a small amount of potassium bromide, and the bleach-fixer D containing a large amount of iron (III) salt of ethylenediaminetetraacetic acid (bleaching agent) and a large amount of ammonium thiosulfate (fixing agent). Further, all the said bleach-fixers are great both in amount of residual silver and in neutral density when the bleach-fixing is effected for a short period of time (2 minutes). Moreover, the film becomes considerably clear in the bleach-fixer B, but when subjected to water-washing later, it becomes opaque due to deposition of silver salt. This opacification is particularly marked when the film is water-washed after bleach-fixing with fatigued bleach-fixer. Thus, the high speed negative film cannot sufficiently be bleach-fixed with the bleach-fixers A to D, which are out of the scope of the present invention.

In contrast, it is understood that when each of the bleach-fixers E to J, which are within the scope of the present invention, is used, desilvering is complete within a far shorter period of time. Further, the film does not become opaque even when it is water-washed immediately after bleach-fixing with any of the bleach-fixers of the present invention. Moreover, all the said bleach-fixers are favorable, like in the case of the control processing, both in amount of residual silver and in neutral density when the bleach-fixing is effected for a short period of time (2 minutes). Accordingly, it is understood that the bleach-fixers of the present invention are extremely favorable in desilvering ability. It was also confirmed that not only the dye image obtained by processing the film with any of the bleach-fixers E to J of the present invention is well comparable to that obtained by the control processing in photographic properties such as color density and possessability of straight line on characteristic curve, but also the color image itself is quite favorable in storage stability. Thus, the bleach-fixers E to J of the present invention are markedly excellent in bleach-fixing efficiency.

In the aforesaid processing (b), the film after color development was subjected to bleach-fixing after any of water-washing, stopping or stop-fixing to obtain the same results as shown in Table 1. Further, the same results as in Table 1 were obtained even when the pH of each of the bleach-fixers E to J was varied to 5.0 and to 8.0.

EXAMPLE 2

Sakura Color Reversal R-100 (a high speed color positive film produced by Konishiroku Photo Industry Co., Ltd.) was exposed to a definite amount of light from a tungsten lamp light source adjusted to a color temperature of 4900° K by use of a filter, and then subjected to such processings (c) and (d) as described below.

c. Control processing:

The film was processed by use of Sakura Color Reversal R-100 Process produced by Konishiroku Photo Industry Co., Ltd.

d. Processing using each of the below-mentioned bleach-fixers L to R

The film was subjected successively to prehardening for 3 minutes, neutralization for 1 minute, first development for 6 minutes, first stopping for 2 minutes, first water-washing for 4 minutes, color development for 9 minutes, second stopping for 3 minutes, second water-washing for 3 minutes, bleach-fixing for at least 4 minutes, third water-washing for 6 minutes and stabilization treatment for 1 minute, and then dried.

All the above-mentioned treatments were carried out at 29.5° ± 0.5° C. Among these treatments, those other than the bleach-fixing were effected by use of Sakura Color Reversal Film Developer, Type 1 (produced by Konishiroku Photo Industry Co., Ltd.). The bleach-fixers L to N mentioned below are control bleach-fixers out of the scope of the present invention, while the bleach-fixers O to R are bleach-fixers within the scope of the present invention.

The composition of each bleach-fixer used was as shown below.

Bleach-fixer L:

Diammonium salt of ethylenediaminetetraacetic acid: 10.0 g.

Iron (III) salt of ethylenediaminetetraacetic acid: 67.5 g.

Sodium sulfite: 15.0 g.

60% Aqueous ammonium thiosulfate solution: 150 ml.
Ammonium bromide: 35.0 g.
Water to make: 1 liter
Adjusted to pH 6.2 with a 28% aqueous ammonium hydroxide solution.

Bleach-fixer M:
Diammonium salt of ethylenediaminetetraacetic acid: 10.0 g.
Iron (III) salt of ethylenediaminetetraacetic acid: 300.0 g.
Sodium sulfite: 15.0 g.
60% Aqueous ammonium thiosulfate solution: 200 ml.
Water to make: 1 liter
Adjusted to pH 6.2 with a 28% aqueous ammonium hydroxide solution.

Bleach-fixer N:
Iron (III) salt of ethylenediaminetetraacetic acid: 100.0 g.
Ammonium bromide: 500.0 g.
Water to make: 1 liter
Adjusted to pH 6.2 with a 28% aqueous ammonium hydroxide solution.

Bleach-fixer O:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 150 ml.
Ammonium bromide: 200.0 g.
Water to make: 1 liter
Adjusted to pH 6.2 with a 28% aqueous ammonium hydroxide solution.

Bleach-fixer P:
Diammonium salt of ethylenediaminetetraacetic acid: 10.0 g.
Iron (III) salt of ethylenediaminetetraacetic acid: 200.0 g.
Ammonium thiocyanate: 100.0 g.
Ammonium bromide: 200.0 g.
N-vinyl-2-pyrrolidone/ethylacrylate/monoethanolamine acrylate (50:45:5)copolymer (MW Ca 30,000): 7.0 g.
Water to make: 1 liter
Adjusted to pH 6.2 with a 28% aqueous ammonium hydroxide solution.

Bleach-fixer Q:
Diammonium salt of ethylenediaminetetraacetic acid: 10.0 g.
Iron (III) salt of ethylenediaminetetraacetic acid: 200.0 g.
Sodium sulfite: 15.0 g.
60% Aqueous ammonium thiosulfate solution: 150 ml
Ammonium iodide: 300.0 g.
Water to make: 1 liter
Adjusted to pH 6.2 with ammonium hydroxide.

Bleach-fixer R:
Diammonium salt of ethylenediaminetetraacetic acid: 10.0 g.
Iron (III) salt of ethylenediaminetetraacetic acid: 300.0 g.
Sodium sulfite: 10.0 g.
60% Aqueous ammonium thiosulfate solution: 100 ml.
Ammonium bromide: 150.0 g.
Water to make: 150.0 g.
Adjusted to pH 6.2 with a 28% aqueous ammonium hydroxide solution.

In the above processing, the bleach-fixers L to R were compared with each other in bleach-fixing efficiency by measuring the bleach-fixing completion time (clearing time) of the film, the amount of residual silver at the time when the film was bleach-fixed for a short period of time (4 minutes), and the neutral density of the processed film. The results obtained were as shown in Table 2. The bleach-fixing completion time and the neutral density are as defined in Example 1.

Table 2

| | | Bleach-fixer out of the scope of the invention | | | Bleach-fixer within the scope the invention | | | |
|---|---|---|---|---|---|---|---|---|
| | Control* | L | M | N | O | P | Q | R |
| Amount of residual silver when bleach-fixing was effected for 4 minutes (mg/100 cm²) | 0 | 7.5 | 18.0 | 6.0 | 0 | 0 | 0 | 0 |
| Neutral density when bleach-fixing was effected for 4 minutes | 3.00 | 3.6 | 3.2 | 3.5 | 3.01 | 3.05 | 2.99 | 3.02 |
| Bleach-fixing completion time (clering time) | 2 min. | More than 30 min. | More than 30 min. | More than 30 min. | 4 min. | 4 min. | 4 min. | 4.5 min. |

*Bleaching and fixing were effected in separate steps.

From Table 2, it is understood that the bleach-fixing does not complete within an ordinary processing time if there is used each of the bleach-fixer L containing iron (III) salt of ethylenediaminetetraacetic acid (bleaching agent), ammonium thiosulfate (fixing agent) and a small amount of ammonium bromide, the bleach-fixer M containing a large amount of iron (III) salt of ethylenediaminetetraacetic acid (bleaching agent) and a large amount of ammonium thiosulfate (fixing agent) but no halide, and the bleach-fixer N containing iron (III) salt of ethylenediaminetetraacetic acid (bleaching agent) and ammonium bromide (fixing agent). Further, all the said bleach-fixers are great both in amount of residual silver and in neutral density when the bleach-fixing is effected for a short period of time (4 minutes). Moreover, the film becomes considerably clear in the bleach-fixer N, but when subjected to water-washing later, it becomes opaque due to deposition of silver salt. Thus, the high speed positive film cannot sufficiently be bleach-fixed with the bleach-fixers L to N, which are out of the scope of the present invention.

In contrast, it is understood that when each of the bleach-fixers O to R, which are within the scope of the present invention, is used, the bleach-fixing is complete within a far shorter period of time. Further, the film does not become opaque even when it is water-washed immediately after bleach-fixing with any of the bleach-fixers of the present invention. Moreover, all the said bleach-fixers are favorable, like in the case of the control processing, both in amount of residual silver and in neutral density when the bleach-fixing is effected for a short period of time (4 minutes). Accordingly, it is understood that the bleach-fixers of the present invention are extremely favorable in desilvering ability. It was also confirmed that the dye image obtained by processing the film with any of the bleach-fixers O to R of the present invention is less in so-called color stains than that obtained according to the control processing. Thus, the bleach-fixers O to R of the present invention are markedly excellent in bleach-fixing efficiency, and, moreover, the photographic properties of images obtained by bleach-fixing the films therewith are also quite favorable.

In the aforesaid processing (d) also, entirely the same results as shown in Table 2 were obtained even when the film was bleach-fixed immediately after color development or the film after color development was bleach-fixed after water-washing. Further, the same results as shown in Table 2 were obtained even when the pH of each of the bleach-fixers O to R was varied to 5.0 and to 8.0.

We claim:

1. A photographic bleach-fixer comprising per liter 0.1 to 1.5 moles of an organometallic complex salt of an organic acid, selected from the group consisting of ethylenediaminetetraacetic acid, nitrilotriacetic acid, diethylenetriaminepentaacetic acid, 1,2-cyclohexanediaminetetraacetic acid, glycol ether diaminetetraacetic acid, oxybis-(ethyleneoxyethylenenitrilo) tetraacetic acid, oxalic acid and citric acid, coordinated with an ion selected from the group consisting of Iron (III), Cobalt (III) and Copper (II) ion, 0.2 to 2.0 moles of a silver halide-fixing agent, and 0.5 to 7.0 moles of a halide of the general formula:

$$A - X$$

wherein A is selected from the group consisting of hydrogen, lithium, sodium, potassium and ammonium; and X is selected from the group consisting of bromine and iodine.

2. A photographic bleach-fixer as defined in claim 1 wherein said silver halide-fixing agent is selected from the group consisting of potassium thiosulfate, sodium thiosulfate and ammonium thiosulfate.

3. A photographic bleach-fixer as defined in claim 1 wherein said silver halide-fixing agent is selected from the group consisting of potassium thiocyanate, sodium thiocyanate and ammonium thiocyanate.

4. A photographic bleach-fixer as defined in claim 1 wherein said silver halide-fixing agent is thiourea.

5. A photographic bleach-fixer as defined in claim 1 wherein said silver halide-fixing agent is thioether.

* * * * *